US005105981A

United States Patent [19]

Gehman

[11] Patent Number: 5,105,981

[45] Date of Patent: Apr. 21, 1992

[54] SELECTIVELY SHAKEABLE, FREESTANDING PARTICULATE MATTER RESERVOIR

[76] Inventor: Thomas Gehman, 570 Seafury Ave., Palm Bay, Fla. 32908

[21] Appl. No.: 615,256

[22] Filed: Nov. 19, 1990

[51] Int. Cl.[5] ..... G01F 11/00

[52] U.S. Cl. ..... 222/1; 222/214; 222/505; 222/512; 222/185

[58] Field of Search ..... 222/185, 214, 505, 511, 222/512, 1

[56] References Cited

U.S. PATENT DOCUMENTS

| | | | |
|---|---|---|---|
| 186,859 | 1/1877 | Doyd | 222/317 |
| 323,413 | 8/1885 | Gibson | 222/345 |
| 2,243,058 | 5/1941 | Wisong | 221/136 |
| 2,775,375 | 12/1956 | Tamminga | 222/185 |
| 2,796,201 | 6/1957 | Dooley | 222/182 |
| 2,900,109 | 8/1959 | Hoopes | 222/1 |
| 3,029,002 | 4/1962 | Gregoire | 222/307 |
| 3,122,278 | 2/1964 | Crozier | 222/305 |
| 3,539,081 | 11/1970 | Norton et al. | 222/185 |
| 3,735,899 | 5/1973 | Rollinson | 222/135 |
| 4,142,651 | 3/1979 | Leopoldi et al. | 222/185 |
| 4,162,751 | 7/1979 | Hetlund et al. | 222/293 |
| 4,358,034 | 11/1982 | Hind | 222/512 X |
| 4,427,136 | 1/1984 | MacKay et al. | 222/368 |
| 4,530,448 | 7/1985 | Ponyicky | 222/511 X |
| 4,715,517 | 12/1987 | Potter et al. | 222/181 |
| 4,784,297 | 11/1988 | Katz | 222/185 X |

*Primary Examiner*—Kevin P. Shaver
*Assistant Examiner*—Joseph A. Kaufman
*Attorney, Agent, or Firm*—Evenson, Wands, Edwards, Lenahan & McKeown

[57] ABSTRACT

A particulate matter dispenser is operated by a push button to move a sliding clamp through a linkage into and out of engagement with an elastic tube at the bottom of a reservoir holding the particulate matter. Coil springs normally bias the sliding clamp into engagement with a fixed clamp or the like so as to hold the tube in a closed position to prevent discharge of material.

7 Claims, 2 Drawing Sheets

SELECTIVELY SHAKEABLE, FREESTANDING PARTICULATE MATTER RESERVOIR

BACKGROUND AND SUMMARY OF THE INVENTION

The present invention relates to a particulate matter dispenser and, more particularly, to a dispenser of simple design and capable of being made from inexpensive parts in which only one finger is needed lightly to press a button to dispense material such that, when the button is pressed down, the rate of powder flow varies.

Various types of dispensing devices, both rotary and nonrotary, have long been known to provide a measured amount of particulate material. For instance, the corn planter shown in U.S. Pat. No. 186,859 utilized a rotatable dropping wheel on a shaft. The wheel had cup-shaped recesses to receive corn from a hopper for discharging into an inclined chute. Likewise, the seed planter of U.S. Pat. No. 323,413 used a rotatable wheel with several pockets to hold the exact number of seeds which it was desired to be planted in a single hill. Other rotatable dispensers using pockets or the like are shown in U.S. Pat. Nos. 2,243,058; 3,029,002 (not rotatable); 3,122,278, 3,735,899; 4,162,751; and 4,427,136. Each of these devices includes a rotary mechanism with one or more pockets for transferring material from a reservoir to a dispenser outlet.

Another type of dispenser was shown in U.S. Pat. No. 2,900,109, in which a dispensing valve is operated automatically or manually in conjunction with a resilient conduit for allowing preheated slurry to flow into a hopper. U.S. Pat. No. 2,796,201 showed a powder dispensing apparatus which uses a hand lever which is pushed up by the palm of the hand which is to receive the dispensed material. Still another dispenser configuration is shown in U.S. Pat. No. 4,715,517. The fluid is dispensed by using the heel of the hand against the front face of a push bar assembly so as to move a roller along tracks and into dispensing contact with a flexible tube which is normally held closed by a guillotine member at the tip of the tube.

I have found, however, that no particulate matter dispensers heretofore available has been able to allow a person to use only one finger lightly to press a button to dispense material in a simple dispenser configuration which can be readily manufactured from, for example, injection molded plastic with relatively few parts which include a metal spring and a rubber tube.

It is, therefore, an object of the present invention to provide a particulate matter dispenser in which only one finger is needed to press lightly on a button to dispense material.

Another object of the present invention is to permit the rate of powder flow to be varied by virtue of the distance that the button is pushed down, with maximum flow at about one teaspoon per second.

Still another object of the present invention is the ability to dispense any amount of powder up to the capacity of the the unit.

Yet another object of the present invention is isolation of the mechanical parts from the dispensed material through a simple design which can be readily manufactured so as to allow a material reservoir of injected molded plastic and rubber dispensing tube to be easily and quickly removed from the unit for cleaning.

A further object of the present invention is the agitation of the dispensed material with a touch and release of the button to shake the reservoir.

The foregoing objects have been achieved in accordance with the present invention by the provision of a particulate dispenser comprising a powder container on a stand with a rubber tube at a dispensing end of the tube. A sliding and fixed clamp selectively open and close the tube to allow a predetermined amount of particulate material to be dispensed by pushing a button which is connected to the sliding clamp through a push rod and pivot arm.

Due to the arrangement of the push button in relation to the container and the linkage, only one finger is needed lightly to press the button to dispense material. In addition, the distance that the button is pressed down, without any further adjustment of the unit, varies the amount of powder or particulate material flowing per unit of time up to the capacity of the reservoir. For a dispenser sized in accordance with a presently contemplated embodiment of the present invention the maximum amount will be about one teaspoon per second.

A reservoir is provided within an outer container so that it and the associated dispensing tube can be easily and quickly removed from the container for cleaning.

A further feature of the present invention is the linkage and clamp system which operates the dispensing tube. With each push and release of the dispensing button the reservoir is shaken by the movement of the rubber tube and the offset of the fixed clamp from the center to one side of the tube.

The unit can be made of injected molded plastic parts except for a metal spring or springs and the rubber dispensing tube. The particulate matter is thus agitated to facilitate its flow through the reservoir to the dispensing tube.

BRIEF DESCRIPTION OF THE DRAWINGS

These and further objects, features and advantages of the present invention will become more apparent from the following detailed description of the presently preferred embodiment when taken in conjunction with the accompanying drawings wherein.

DETAILED DESCRIPTION OF THE DRAWINGS

Figure 1:
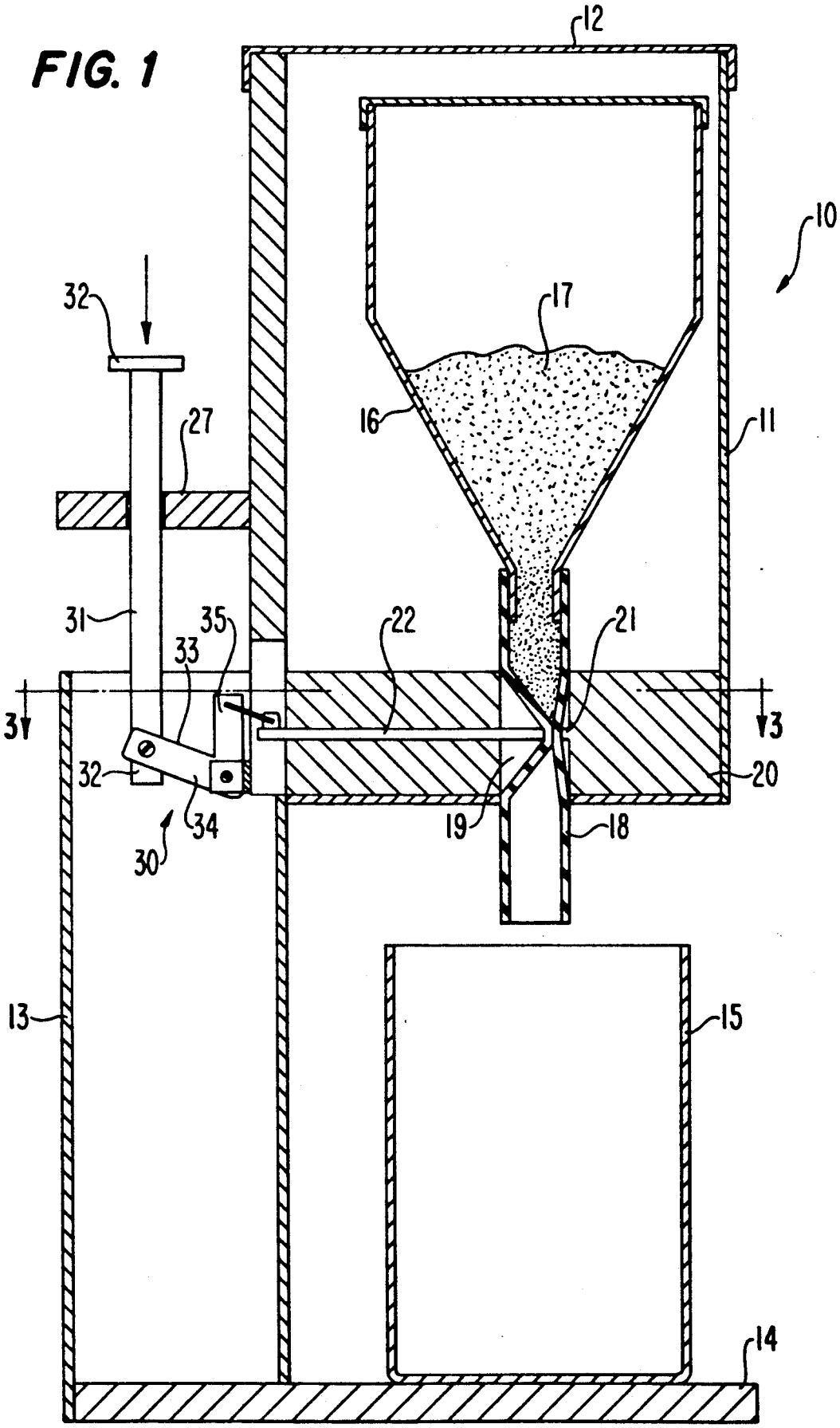
FIG. 1 is a cross-sectional side elevational view of the dispensing unit in accordance with the present invention in the non-dispensing position.

The dispenser unit is designated generally by the numeral 10 and includes an outer housing or casing 11 with a removable top cover 12. The casing 11 is mounted on a stand 13 having a platform 14 upon which a container 15 can be placed to receive dispensed material as hereinafter described. A funnel-shaped reservoir 16 is located inside the casing 11 for the purpose of holding a desired volume of particulate material 17 which is to be dispensed into the contgainer 15. As shown in FIG. 1, the reservoir 16 is sized and configured to be placed in a freestanding manner inside the casing 11, i.e., there is some distance between the reservoir 16 and inner walls of the casing 11 to allow removal of the reservoir 16 for cleaning an also to facilitate shaking of the reservoir 16 to agitate the particulate material 17 therein.

A flexible discharge tube 18 made of rubber or any other suitable elastic material is fitted over the discharge end of the reservoir 16. The tube 18 is sized and configured to extend through a rectangular aperture 19 in a base plate 20 at the bottom of the casing 11. One face of the aperture 19 has a projecting portion 21 which constitutes a fixed clamp which cooperates with a hereinafter-described movable clamp 22 selectively to open and close the flexible tube 18 for discharging the particulate material 17 in the reservoir 16.

Figure 3:
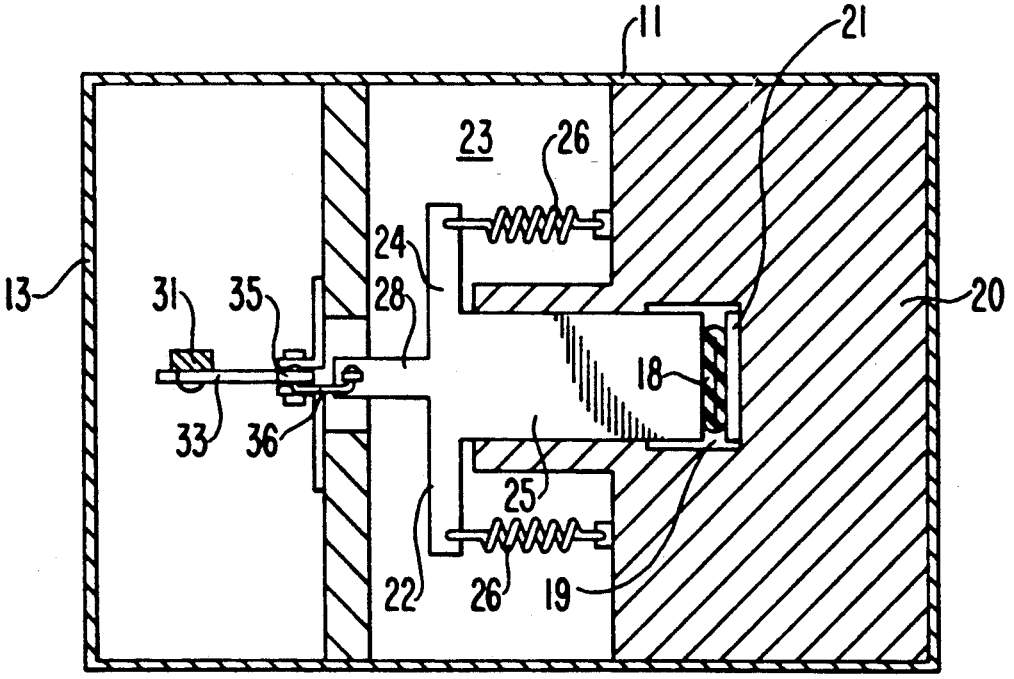
FIG. 3 is a cross-sectional view taken along line 3—3 of FIG. 1.

The movable clamp 22 is arranged inside the plate 20 within an open area 23 as best seen in FIG. 3. The movable clamp 22 is in the form of a relatively thick T-shaped member having a cross-member 24 and a longitudinally displaceable member 25 extending toward the fixed clamp 21 with the flexible tube 18 therebetween. Coil springs 26 connect the cross-member 24 with the plate 20 so as normally to bias the movable clamp 22 against the flexible tube 19 to hold the latter in a closed position.

A linkage designated generally by the numeral 30 in FIG. 1 is used to actuate the movable clamp 22 when it is desired to discharge a certain amount of particulate material 17 from the reservoir 16. In particular, a push rod 31 having a push button 32 at its free end extends parallel to the casing 11 and through a support guide 17 affixed to the casing 11. The end 32 of the push rod 31 extending into the stand 13 is pivotally connected to one arm 34 an approximately V-shaped pivot arm 33. The outer arm 35 of the pivot arm 33 is connected by a link 36 to a longitudinal extension 28 of the movable clamp 22. The link 36 is connected in such a manner, as is generally known, to translate pivotal movement of the arm 33 into rectilinear movement of the movable clamp 22 against the bias of the spring 26.

Figure 2:
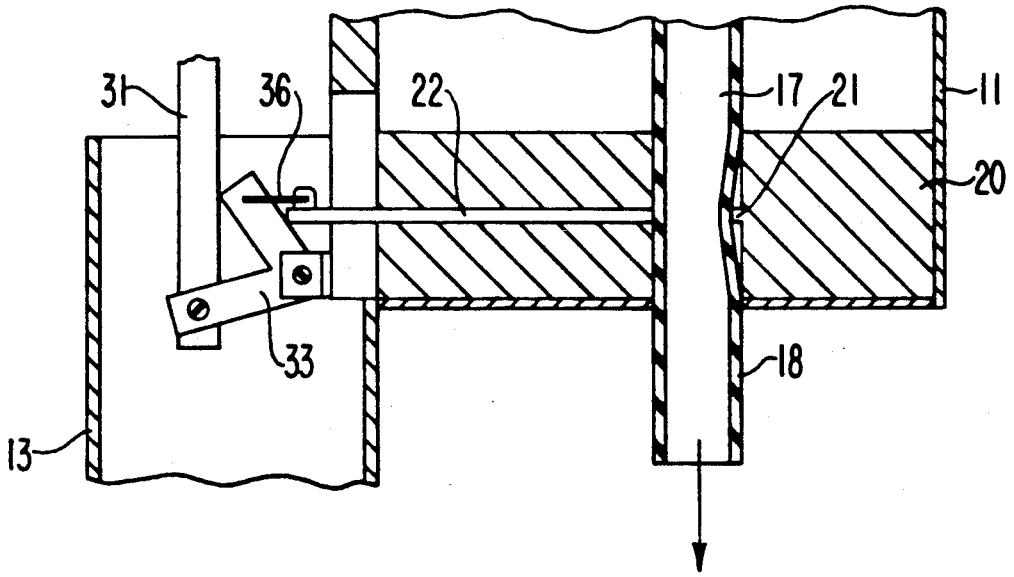
FIG. 2 is an isolated cross-sectional view of the unit of FIG. 1 in the full dispensing position.

In the normal position of the dispenser 10, i.e., when it is not being used to discharge the particulate material 17 held in the reservoir 16, as shown in FIG. 1, the coil springs 26 bias the movable clamp 22 against the flexible tube 18 to close the latter in cooperation with the fixed clamp 21. At the same time, the springs provide sufficient force to return the linkage 30 into the position shown where the arm 35 of the V-shaped arm 33 pivotally connected to the casing 11 inside the stand 13 is substantially vertical. When it is desired to discharge a certain amount of particulate material 17 into, for example, the cup 15, the person using the dispenser simply lightly presses the button 32 on the rod 31. The small amount of force on the button 32 is sufficient to operate the movable clamp 22 through the linkage 30. Depending upon how fast the person wants the material 17 discharged, the user will push down to a greater or lesser extent; the former will produce a greater flow rate since a larger area of the tube 18 is available for discharge, and the latter will produce a smaller flow rate. The fully open position is shown in FIG. 2. Furthermore, due to the arrangement of the linkage 30 and the reservoir 16 in the dispenser, pushing down on the button 32 will serve to shake the reservoir 16 and agitate the material 17 and then releasing the button therein to facilitate dispensing of the material in an even manner. It will be understood that the elastic tube 17 returns to its fully open position when the movable clamp 22 slides away from the fixed clamp 21 due to the tube's elastic properties. By merely releasing the button 32, the movable clamp 22 will be moved back into the fully closed position shown in FIGS. 1 and 3 under the bias of the tension coil springs 26.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A particulate matter dispenser, comprising a particulate matter reservoir having a discharge end and operatively disposed in an outer casing in a freestanding manner to allow selective agitation of particulate matter therein;

an elastic tube connected with the discharge end and extending into an opening in the casing to hold the reservoir in the freestanding manner;

means for clamping the tube into a normally closed, nondispensing position disposed at only one point intermediate ends of the tube; and means for operating the clamp means with a single-finger push button such that the selective agitation of the particulate matter takes place only upon pushing and releasing of the push button.

2. The dispenser according to claim 1, wherein the clamping means comprises a fixed clamp and a movable clamp between which the tube is disposed, and at least one spring for normally biasing the movable clamp into the non-dispensing position toward the fixed clamp.

3. The dispenser according to claim 1, wherein the operating means comprises a push rod on which the push button is arranged and a pivot arm operatively connected between the push rod and the movable clamp.

4. The dispenser according to claim 3, wherein the clamping means comprises a fixed clamp and a movable clamp between which the tube is disposed, and at least one spring for normally biasing the movable clamp into the non-dispensing position toward the fixed clamp.

5. The dispenser according to claim 4, wherein the reservoir is funnel-shaped toward its discharge end.

6. The dispenser according to claim 3, wherein the pivot arm is V-shaped and has one member pivotally connected with the push rod and another member connected with the movable clamp to effect sliding of the latter away from the fixed clamp, and the pivot arm being pivoted in relation to the casing at a point where the two members are joined.

7. A method for dispensing particulate matter, comprising the steps of:

supporting a reservoir in a dispenser so as to be freestanding sufficiently using a normally closed elastic dispensing tube to allow selective agitation of the particulate matter;

filling the reservoir with a desired quantity of the particulate matter; and dispensing the particulate matter through said normally closed elastic dispensing tube, wherein only during the step of dispensing does the selective agitation of the particulate matter occur.

* * * * *